United States Patent [19]

Hug

[11] 4,000,783

[45] Jan. 4, 1977

[54] CONICAL BORING TOOL

[75] Inventor: Hans Albert Hug, Weston, Mass.

[73] Assignee: Foster-Miller Associates, Inc., Waltham, Mass.

[22] Filed: Oct. 20, 1975

[21] Appl. No.: 623,807

[52] U.S. Cl. ..... 175/346; 175/371; 175/374; 308/8.2

[51] Int. Cl.[2] ..... E21B 9/10

[58] Field of Search ..... 175/344, 345, 346, 342, 175/363; 308/194, 8.2

[56] References Cited

UNITED STATES PATENTS

| | | | |
|---|---|---|---|
| 1,302,058 | 4/1919 | Layne | 175/345 X |
| 2,122,763 | 7/1938 | Smith, Jr. | 175/346 |
| 2,187,037 | 1/1940 | Kirkpatrick | 175/347 X |
| 3,306,379 | 2/1967 | Kloesel | 175/345 |
| 3,845,999 | 11/1974 | Zimmer et al. | 308/194 |
| 3,897,837 | 8/1975 | Peterson | 175/347 X |

*Primary Examiner*—Ernest R. Purser
*Assistant Examiner*—Richard E. Favreau
*Attorney, Agent, or Firm*—Morse, Altman, Oates & Bello

[57] ABSTRACT

A self-advancing conical boring tool with frusto-conical roller cutters rotatably mounted to a tapered frame by means of self-aligning spherical roller bearings. Each roller cutter is constrained within a pair of spherical roller bearings for free rotation about an axis that is both oblique and skewed relative to a longitudinal axis of the frame.

11 Claims, 8 Drawing Figures

NO SKEW
$\beta = 0$

NEUTRAL SKEW
$\beta = \beta_o$

FORWARD SKEW
$\beta > \beta_o$

CONICAL BORING TOOL

BACKGROUND OF THE INVENTION

1. Field of Invention

The present invention relates to drilling equipment and, more particularly, is directed toward rock boring tools.

2. Description of the Prior Art

Generally, rotary conical roller bits for reaming pilot holes drilled in rock include rotary cutters that are supported in fixed bearings mounted to a frame. The rotary cutters are moved over the surface being cut at substantially right angles to the plane thereof. When roller bits arrive at hard formations, much difficulty is experienced. Advancement of the bit is very slow and the wear on the cutting edges is excessive. Furthermore, the stress on the roller bit is such as to cause a misalignment of the rotary cutters and fixed bearings which results in premature failure of the bearings. A need has arisen for improvements in rotary conical roller bits.

SUMMARY OF THE INVENTION

It is an object of the present invention to provide a self-advancing conical boring tool characterized by frusto-conical roller cutters that are rotatably supported in self-aligning spherical roller bearings mounted to a tapered frame. The roller cutters are circumferentially disposed about a centerline of the boring tool, each roller cutter constrained within a pair of spherical roller bearings for free rotation about an axis that is both oblique and skewed with respect to a longitudinal axis of the frame. Each roller cutter is provided with a shaft that extends outwardly from opposite ends thereof, the shaft being coaxial with the roller cutter rotational axis. The extending shaft ends are snugly received within self-aligning spherical roller bearings that maintain proper alignment with the roller cutter rotational axis under stress conditions. The relative orientation of each roller cutter and the frame is such that the roller cutters are self-advancing as the boring tool is rotated.

Other objects of the present invention will in part be obvious and will in part appear hereinafter.

The invention accordingly comprises the devices, together with their parts, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENT

Figure 1:
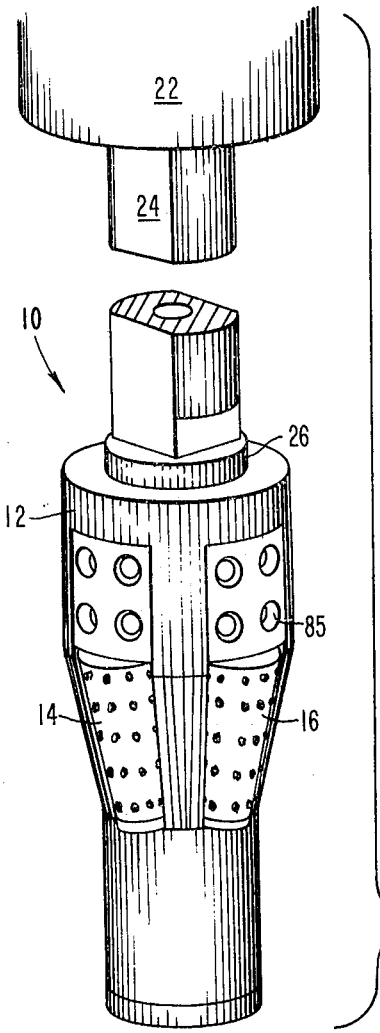
FIG. 1 is a perspective view of rotary drilling system which includes a conical boring tool embodying the present invention.
Figure 3:
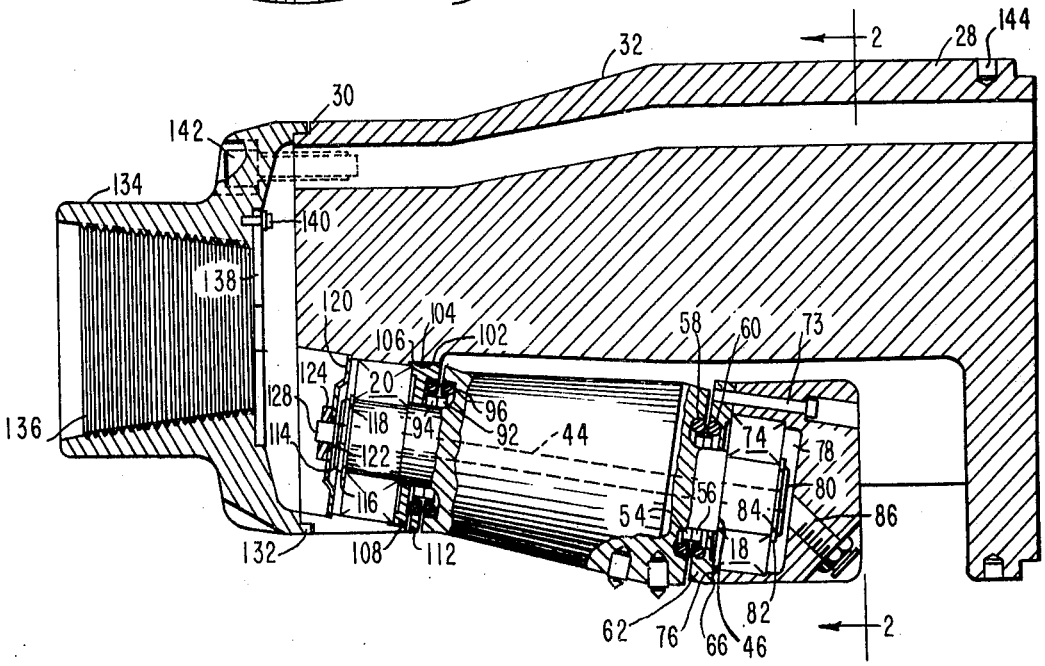
FIG. 3 is a sectional view taken along the lines 3—3 in FIG. 2.

In the embodiment of the invention illustrated in the drawings, FIG. 1 shows a self-advancing rotary conical boring tool 10 for reaming a pilot hole drilled in a rock formation. Conical boring tool 10 comprises a frame 12 having a plurality of roller cutters 14, typically three in number, circumferentially disposed about the centerline of the boring tool. A plurality of teeth 16, for example tungsten carbide teeth, are disposed about the periphery of each cutter 14. As shown in FIG. 3, each roller cutter 14 is constrained with a pair of self-aligning spherical roller bearings 18 and 20 for free rotation about an axis that is both oblique and skewed with respect to a longitudinal axis of frame 12.

Figure 5:
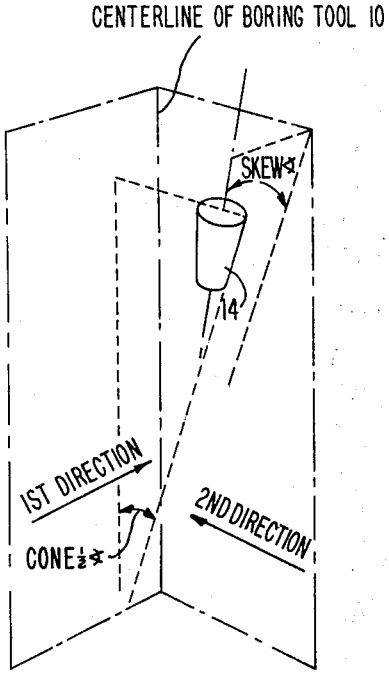
FIG. 5 is a schematic drawing illustrating certain principles of the invention.

As graphically illustrated in FIG. 5, the position of each cutter 14 relative to the centerline of boring tool 10 is described by a cone half angle and a skew angle. The cone half angle is the angle formed between the longitudinal axis of the boring tool and a longitudinally extending facial line of the roller cutter most removed from the tool centerline when viewed from a first direction and the skew angle is the angle formed between the longitudinal axis of the boring tool and the longitudinal axis of the roller cutter when viewed from a second direction that is at right angles to the first direction. Typically, the cone half angle is in the range of 12° to 20°, and preferably is 18°. The skew angle typically is in the range of 2° to 6°, and preferably is 4°.

In operation, a rotary drive unit 22, for example a blast hole drill, is connected to one end of a drill pipe 24, the other end of which is secured to an adaptor 26 that is fastened to frame 12. Rotary drive unit 22 is operative to rotate the conical boring tool in a first direction, for example a clockwise direction. As the conical boring tool rotates in the clockwise direction, roller cutters 14 rotate in an opposite or counterclockwise direction. The position of each roller cutter 14 as hereinbefore described is such that conical boring tool 10 is self-advancing as the roller cutters rotate and teeth 16 engage the sidewalls of the pilot hole. The details of conical boring tool 10 are shown in FIGS. 2, 3 and 4.

Figure 2:
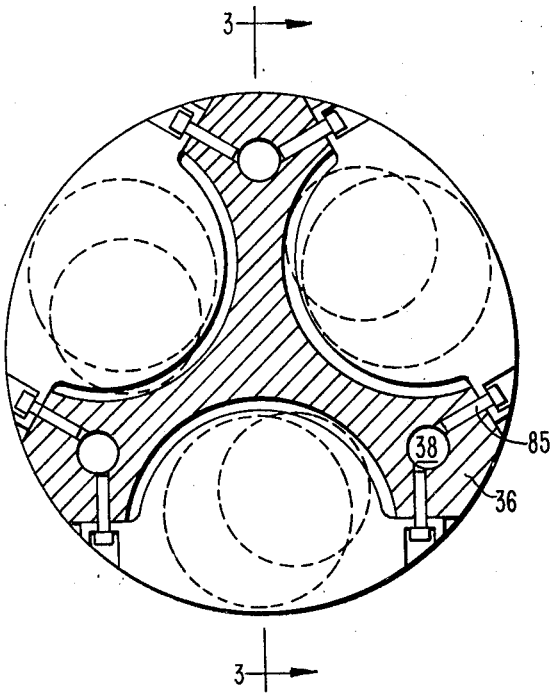
FIG. 2 is a sectional view taken along the lines 2—2 in FIG. 3.
Figure 4:
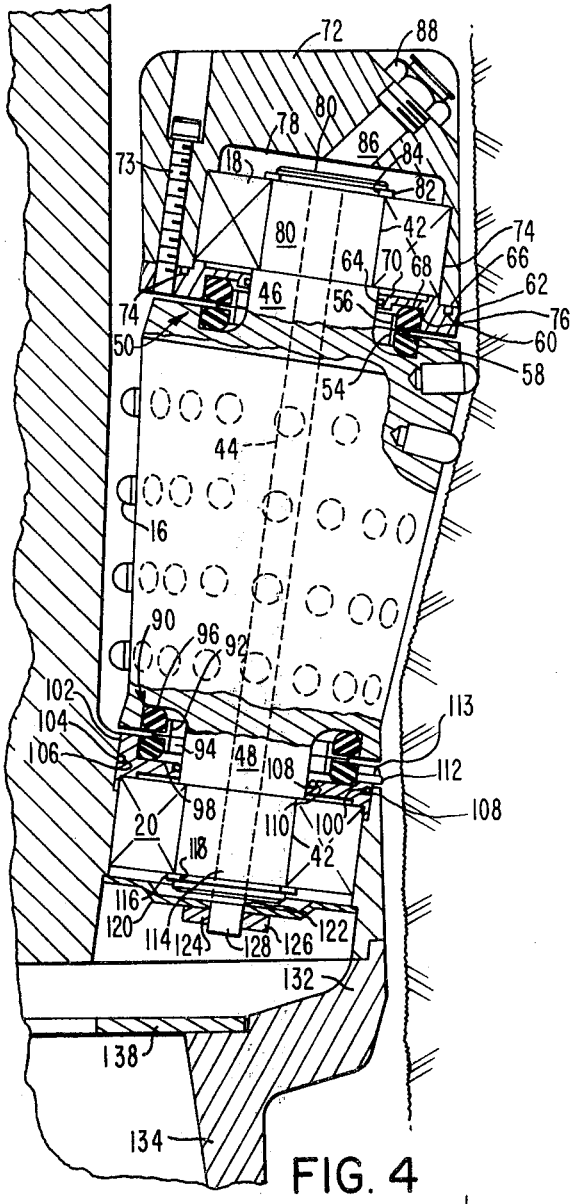
FIG. 4 is a side elevation, partly in section, of a roller cutter mounting assembly.

Referring now to FIGS. 2, 3 and 4, it will be seen that frame 12 has a substantially frusto-conical profile in right cross section and includes a cylindrical upper section 28, a cylindrical lower section 30, and a tapered medial section 32 interconnecting the upper and lower sections. In the illustrated embodiment, by way of example, the diameter of upper section 28 is approximately 14.5 inches and the diameter of lower section 30 is approximately 7.0 inches. Tapered medial section 32 is formed with recesses 34, each of which is configured to receive one roller cutter 14. The regions of medial section 32 between adjacent recesses 34 constitute struts 36, each of which has a substantially triangular profile in right cross section. Teeth 16 project outwardly of the exterior surface of each strut 36 for engagement with the sidewall of the pilot hole. A bore 38, for example a 1.0 inch hole which extends through each strut 36, is provided for carrying a flushing fluid such as air to the lower end of boring tool 10.

Each roller cutter 14 includes a frusto-conical body 40. A shaft 42, which is coaxial with body 40, is formed with a central passage 44, an end 46 of shaft 42 extending from a wide end of body 40 and an end 48 of shaft 42 extending from a narrow end of body 40. A seal 50, for example a metal faced seal constituting a pair of metallic rings 54, 56 and a pair of elastomeric rings 58, 60 which are bonded together to form an integral seal having a substantially U-shaped profile in right cross section, is provided for keeping foreign matter such as dirt from reaching spherical roller bearing 18. The inner surfaces of metallic rings 54 and 56 are disposed about end 46 of shaft 42 and elastomeric ring 58 is pressed against the upper face of body 40. A thrust plate 62 having O-rings 64 and 66 is pressed against elastomeric ring 60, thrust plate 62 being formed with a shoulder 68 that is configured to receive elastomeric ring 60. O-ring 64, which is seated within a groove 70 formed in thrust plate 62, is in engagement with end 46 of shaft 42. Thrust plate 62 is secured to a pillow block 72 by means of bolts 73. An annular flange 74 of pillow block 72 is pressed against O-ring 66 which is seated in a groove 76 formed in the upper surface of thrust plate 62. Pillow block 72 is formed with a central bore 78 that is configured to snugly receive spherical roller bearing 18. A reduced portion 80 of shaft 42 at end 46 defines a stub shaft which is supported within spherical roller bearing 18. A snap ring 82 is pressed into an annular groove 84 formed in the end of stub shaft 80. Pillow block 72 is mounted to body 40 by means of bolts 85. A hole 86 formed in pillow block 72 is provided with a grease fitting 88 for charging passage 44 with a lubricant such as grease.

A seal 90, which is similar to seal 50 and includes metallic rings 92, 94 and a pair of elastomeric rings 96, 98 that are bonded together to form an integral seal having a substantially U-shaped profile in right cross section, is provided for keeping foreign matter such as dirt from reaching spherical roller bearing 20. The inner surfaces of metallic rings 92 and 94 are disposed about end 48 of shaft 42 and elastomeric ring 96 is pressed against the lower face of body 40. An adaptor plate 100 having an annular shoulder 102 is pressed against elastomeric ring 98. An O-ring 104 is seated in a groove 106 formed in an outer face of adaptor plate 100 and an O-ring 108 is seated in a groove 110 formed in an inner face of adaptor plate 100. A steel dowel 112, which is pressed into a hole 113 formed in shoulder 102, engages seal 90. Spherical roller bearing 20, which is received about a reduced portion or stub shaft 114 of shaft 42 at end 46, abuts adaptor plate 100. A snap ring 116 is pressed into an annular groove 118 formed in the end of stub shaft 114. A cap plate 120 formed with a central opening 122 is mounted to frame 12, central opening 122 being coaxial with passage 44. A boss 124, which is mounted to cap plate 120, is formed with a threaded hole 126 that is coaxial with opening 112. A plug 128 is turned into threaded hole 126. A lubricant, for example grease, is supplied to passage 44 through opening 122, plug 128 being provided to seal opening 122.

The lower end of frame 12 ia provided with an annular shoulder 130 which is adapted for mating engagement with a shoulder 132 formed in a cap 134 having an internally threaded section 136. An orifice plate 138 is mounted to cap 134 by means of bolts 140. Cap 134 is secured to frame 12 by means of bolts 142. The upper end of frame 12 is provided with a row of wear buttons 144 that are annularly disposed about frame 12. Buttons 144 are provided for limiting wear on frame 12 during reaming of the pilot hole.

Figure 6A:
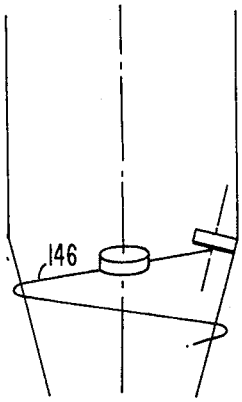
FIGS. 6A, 6B and 6C are schematic drawings illustrating certain principles of the invention.
Figure 6B:
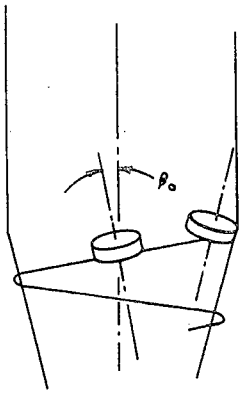
Figure 6C:
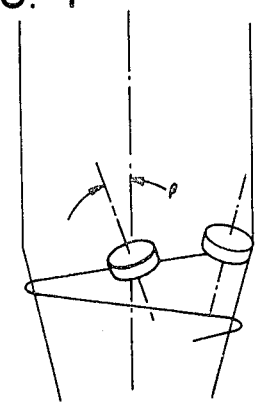

In practice, it is preferred that each roller cutter 14 and its associated spherical roller bearings 18 and 20 are assembled before being inserted into frame 12. As previously indicated, each roller cutter 14 is constrained for free rotation about its longitudinal axis which is both oblique and skewed with respect to the longitudinal axis of boring tool 10. The orientation of roller cutters 14 provides a self-advancing action as the conical boring tool is rotated. The skew angle at which the roller cutters are disposed is greater than the neutral skew angle. That is, when the skew angle is zero, as shown in FIG. 6A, the locus of the contact point of the teeth and rock defines a helix 146 as the roller cutters rotate and advance. If the roller cutters are skewed at an angle $\beta_o$ which corresponds to the angle of helix 146 or neutral skew angle as illustrated in FIG. 6B, the roller cutters would experience pure rolling. In the present invention, the roller cutters are disposed at a skew angle $\beta$ shown in FIG. 6C, skew angle $\beta$ is greater than skew angle $\beta_0$ and the roller cutters experience a rearward skidding motion as they contact the rock. In consequence, the cutters attempt to roll ahead in advance of the boring tool and provide a self-advancing action.

In one example of operation, blast hole drill rotates conical boring tool 10 in a clockwise direction and roller cutters 14 rotate in a counterclockwise direction as they engage the sidewalls of the pilot hole. Although the roller cutters are subjected to extreme conditions of stress as they chip-away and ream the pilot hole, spherical roller bearings 18 and 20 self adjust to compensate for any misalignment of shaft 42. The self-adjusting configuration of spherical roller bearings 18 and 20 prevents premature failure of the spherical roller bearings. That is, spherical roller bearings 18, 20 and shaft 42 are maintained in an aligned position although shaft 42 roller cutters 14 are displaced by stress produced during the cutting operation. In the event that spherical roller bearing 18 fails, thrust plate 62 cooperates with roller cutter 14 and constitutes a bearing surface on which the roller cutter rotates. In other words, spherical roller bearings 18 and 20 define primary bearings and thrust plate 62 defines a secondary bearing.

Since certain changes may be made in the foregoing disclosure without departing from the scope of the invention herein described, it is intended that all matter contained in the above description and depicted in the accompanying drawings be construed in an illustrative and not in a limiting sense.

What is claimed is:

1. A self-advancing conical boring tool comprising:

a. a tapered frame formed with a plurality of circumferentially disposed recesses;

b. a pair of self-aligning spherical roller bearing mounted within each of said recesses;

c. a roller cutter supported in each said pair of spherical roller bearings, each said roller cutter having a wide upper portion and a narrow lower portion constituting a frusto-conical body and a shaft, a longitudinal axis of said body coaxial with a longitudinal axis of said shaft, one end of said shaft received in one of said pair of spherical roller bearings and an opposite end of said shaft received in the other of said pair of spherical roller bearings;

d. a thrust plate interposed between said wide upper portion of each said roller cutter and said one of said pair of spherical roller bearing, said spherical roller bearings constituting primary bearings, said thrust plate constituting a secondary bearing when said one of said pair of spherical roller bearings fails; and e. a plurality of teeth projecting outwardly from the periphery of each said roller cutter;

f. each said roller cutter constrained within each said pair of spherical roller bearings for free rotation about an axis that is both oblique and skewed relative to a longitudinal axis of said frame.

2. A self-advancing rock boring tool for reaming a pilot hole in a rock formation, said tool comprising:

a. a tapered frame formed with at least one circumferentially disposed recess;

b. a roller cutter supported in each said recess, each said roller cutter including a substantially frusto-conical body having a plurality of projecting teeth disposed about its periphery for engaging the rock formation;

c. a pair of self-aligning spherical roller bearings operatively connected to each said roller cutter and to said frame, said body constrained for free rotation about an axis that is both oblique and skewed relative to a longitudinal axis of said frame;

d. a thrust plate interposed between a wide upper portion of each said roller cutter and one of said pair of spherical roller bearings, said thrust plate constituting a secondary bearing when said one of said pair of spherical roller bearings fails; and e. drive means operatively connected to said frame for rotating said frame in a first direction, each said roller cutter rotating in a second direction when said teeth contact the rock formation, said first direction opposite said second direction.

3. A self-advancing conical boring tool comprising:

a. a tapered frame formed with a plurality of circumferentially disposed recesses;

b. a pair of self-aligning spherical roller bearing mounted within each of said recesses, said spherical roller bearings constituting primary bearings;

c. a roller cutter supported in each said pair of spherical roller bearings, each said roller cutter having a frusto-conical body and a shaft, a longitudinal axis of said body coaxial with a longitudinal axis of said shaft, one end of said shaft received in one of said pair of spherical roller bearings and an opposite end of said shaft received in the other of said pair of spherical roller bearings; and d. a thrust plate interposed between a wide upper portion of each said roller cutter and said one of said pair of spherical roller bearings, said thrust plate constituting a secondary bearing when said one of said pair of spherical roller bearings fails;

e. each said roller cutter constrained within each said pair of spherical roller bearings for free rotation about an axis that is both oblique and skewed relative to a longitudinal axis of said frame.

4. The conical boring tool as claimed in claim 3 including a dirt exclusion seal disposed about each end of said roller cutter shaft.

5. The conical boring tool as claimed in claim 3 wherein said axis about which each said roller cutter rotates is at a cone half angle and a skew angle, said cone half angle being an angle formed between the longitudinal axis of said frame and a longitudinally extending facial line of said roller cutter most removed from the longitudinal axis of said frame when viewed from a first direction, said skew angle being an angle formed between the longitudinal axis of said frame and the longitudinal axis of said roller cutter when viewed from a second direction that is at right angles to said first direction.

6. The conical boring tool as claimed in claim 5 wherein said skew angle is greater than a neutral skew angle.

7. The conical boring tool as claimed in claim 5 wherein said cone half angle is in the range of 12° to 20° and said skew angle is in the range of 2° to 6°.

8. The conical boring tool as claimed in claim 7 wherein said cone half angle is 18° and said skew angle is 4°.

9. The conical boring tool as claimed in claim 3 wherein said roller cutter rotational axis is disposed at a cone half angle and a skew angle, said cone half angle formed between the longitudinal axis of said frame and a longitudinally extending facial line of said roller cutter most removed from the longitudinal axis of said frame when viewed from a first direction, said skew angle formed between the longitudinal axis of said frame and the longitudinal axis of said roller cutter when viewed from a second direction that is at right angles to said first direction.

10. The conical boring tool as claimed in claim 9 wherein said cone half angle is in the range of 12° to 20° and said skew angle is in the range of 2° to 6°, said skew angle being greater than than a neutral skew angle.

11. The conical boring tool as claimed in claim 10 wherein said cone half angle is 18° and said skew angle is 4°.

* * * * *